US006176633B1

(12) United States Patent
Andrews et al.

(10) Patent No.: US 6,176,633 B1
(45) Date of Patent: Jan. 23, 2001

(54) MARKING INSTRUMENT

(75) Inventors: Neville Edgar Andrews, Horsham; Glenn Andrew Groom, Eastbourne; Mark Harrison, Brighton, all of (GB)

(73) Assignee: Parker Pen Products (GB)

( * ) Notice: Under 35 U.S.C. 154(b), the term of this patent shall be extended for 0 days.

(21) Appl. No.: 09/428,422

(22) Filed: Oct. 28, 1999

Related U.S. Application Data

(63) Continuation of application No. PCT/GB98/01315, filed on May 7, 1998.

(30) Foreign Application Priority Data

May 9, 1997 (GB) ..... 9709513

(51) Int. Cl.[7] ..... B43K 5/14; B43K 5/10
(52) U.S. Cl. ..... 401/232; 401/151
(58) Field of Search ..... 401/132–134, 401/222, 230, 232, 236, 237, 241, 151

(56) References Cited

U.S. PATENT DOCUMENTS 4,973,180 11/1990 Hori ..... 401/141

FOREIGN PATENT DOCUMENTS 0413273 2/1991 (EP) .
0476492 3/1992 (EP) .
2604640 4/1988 (FR) .
728188 * 4/1955 (GB) ..... 401/133
2146588 4/1985 (GB) .
9516577 6/1995 (WO) .

* cited by examiner

*Primary Examiner*—Charles R. Eloshway
(74) *Attorney, Agent, or Firm*—Ladas & Parry

(57) ABSTRACT

A marking insturment having a fluid reservoir (1) and an application tip. A valve (7, 12, 18) controls flow of fluid from the reservoir (1) to the tip. A transfer chamber (21) is located between the reservoir and tip and is assocaited with the reserovir housing (1) in said manner as to be reduceable in volume.

6 Claims, 4 Drawing Sheets

MARKING INSTRUMENT

This application is a continuation of copending application(s) International Application PCT/GB98/01315 filed on MAY 07, 1998 and which designated the U.S., claims the benefit thereof and incorporates the same by reference.

This invention relates to marking instruments of the type in which a valve device is provided to control flow of marking fluid from a reservoir chamber to a marking tip used to apply the marking fluid to a surface. The invention has particular application to reservoir pens, and is specifically described herein in relation thereto, but the invention can also be incorporated with advantage in other types of marking instrument.

In WO 95/16577 there is described a valve device for controlling flow of marking liquid from a reservoir to a feed system for delivery to a marking tip, wherein the valve is operated by a member influenced by ambient atmospheric pressure and by the pressure in the feed system downstream of the valve so that the valve is opened when the pressure differential reaches a given level. Several embodiments of valve devices suitable for incorporation in a replaceable ink reservoir or cartridge are described and have been found to work effectively. However, difficulties can be encountered in establishing an initial ink flow when an empty ink cartridge is replaced with a full cartridge, especially if the ink feed system incorporated in the writing instrument into which the cartridge is installed has dried out so that capillary suction within the feed system can not reliably reduce the pressure in the feed system in order to open the valve.

The present invention addresses the problem explained above and in accordance with a first aspect the invention provides a cartridge for a marking instrument, comprising a body enclosing a reservoir chamber and a transfer chamber connected to the reservoir chamber by a feed path controlled by a valve, the transfer chamber being confined in part by a member displaceable upon engagement of the cartridge with a marking instrument to reduce the volume of the transfer chamber for positive feed of marking fluid from the transfer chamber.

With a cartridge according to the invention, engaging the cartridge with the marking instrument will result in a small amount of marking fluid being pumped from the transfer chamber into the feed system leading to the marking tip of the marking instrument thereby priming the fluid delivery system so that an initial supply of marking fluid to the tip is ensured and reliable subsequent control of the fluid supply from the reservoir chamber by operation of the valve device can be readily achieved.

In an especially convenient construction the displaceable member closes the forward end of the transfer chamber and communication between the transfer chamber and the feed system of the marking instrument is established through this member. With this construction the communication can be opened and the member displaced to cause marking fluid to be delivered from the transfer chamber by a longitudinal movement of the cartridge body e.g. brought about by a threaded engagement of the body with the marking instrument.

In the particular embodiments described in WO 95/16577, the valve devices include valve members which are inserted into their valve chambers in a direction transverse to the axis of the reservoir chamber. Such arrangements tend to complicate manufacture as current cartridge manufacturing methods and equipment favour an axial assembly of cartridge components.

With a view to facilitating assembly, according to a second aspect the present invention provides a marking instrument reservoir for controlled delivery of marking fluid comprising a reservoir chamber having an axis, a transfer chamber, a valve device for controlling communication between the reservoir chamber and transfer chamber, the valve device having a seat and a valve member including a sealing portion for co-operation with the seat and an actuating portion exposed on one side to the pressure in the transfer chamber and on the other side to atmospheric pressure, the valve seat and valve member being assembled in substantially coaxial alignment with the reservoir chamber.

In a particularly convenient construction the valve seat is cylindrical and defined by an axial spigot integral with a valve housing member. The housing member is a plastics moulding which is attached to the forward end of the cartridge case which encloses the reservoir camber. The spigot extends through the front end wall of the case and includes an ink channel which connects the interior of the reservoir to the valve seat. The valve member includes a cylindrical sealing part which extends around and normally contacts the valve seat, and an annular diaphragm which separates an air chamber from the transfer chamber within the valve housing. The valve member also includes an annular lip for sealing between the exterior of the spigot and the front wall of the cartridge case.

To enable a clear understanding of the invention a particular embodiment will now be described in more detail with reference to the accompanying drawings, in which.

Figure 1:
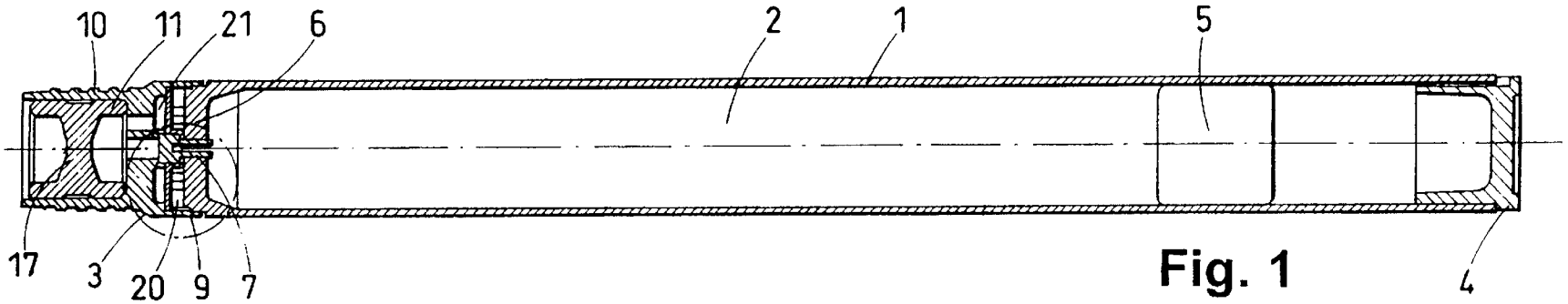
FIG. 1 is an axial cross-section through an ink cartridge constructed in accordance with the invention.
Figure 3:
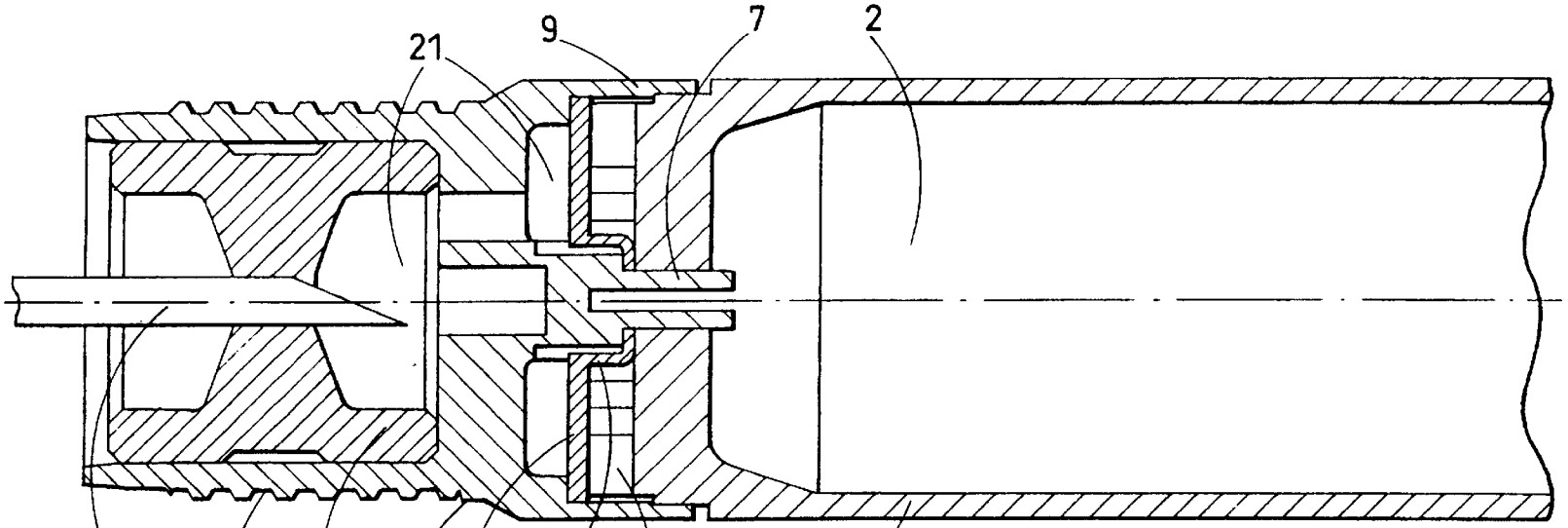
Figure 2A:
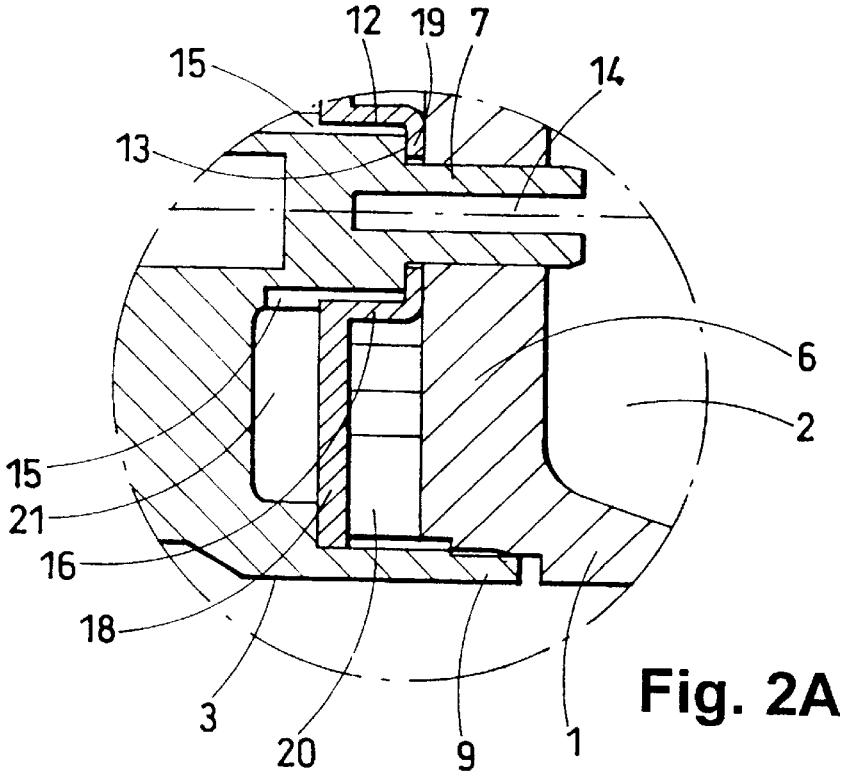
FIG. 2A is an enlarged view of the part of the cartridge shown circled in FIG. 1; and showing the valve in a closed condition.
Figure 2B:
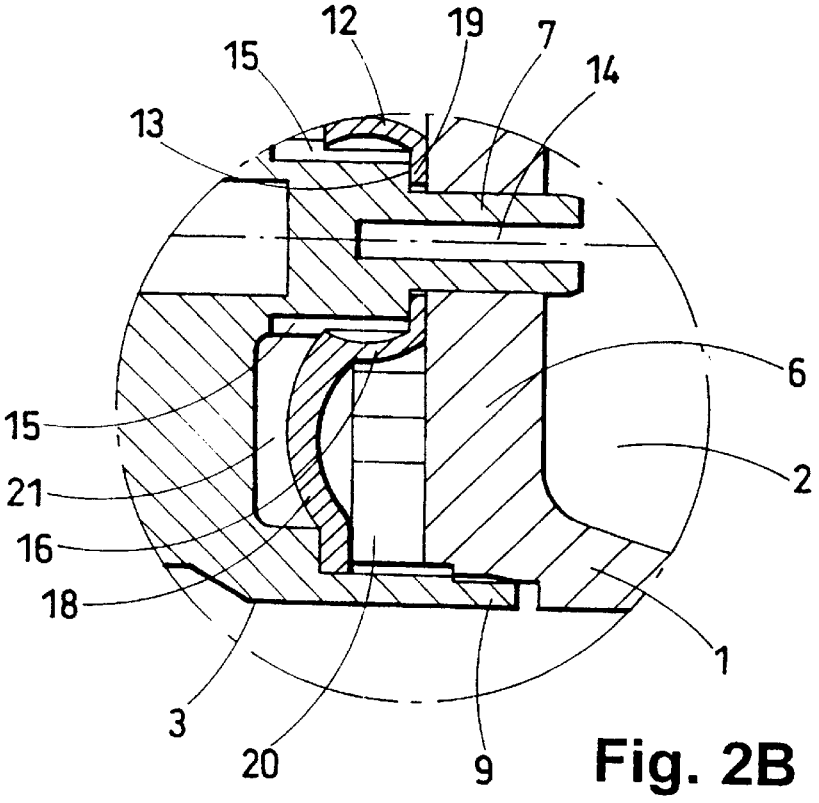
Figure 4:
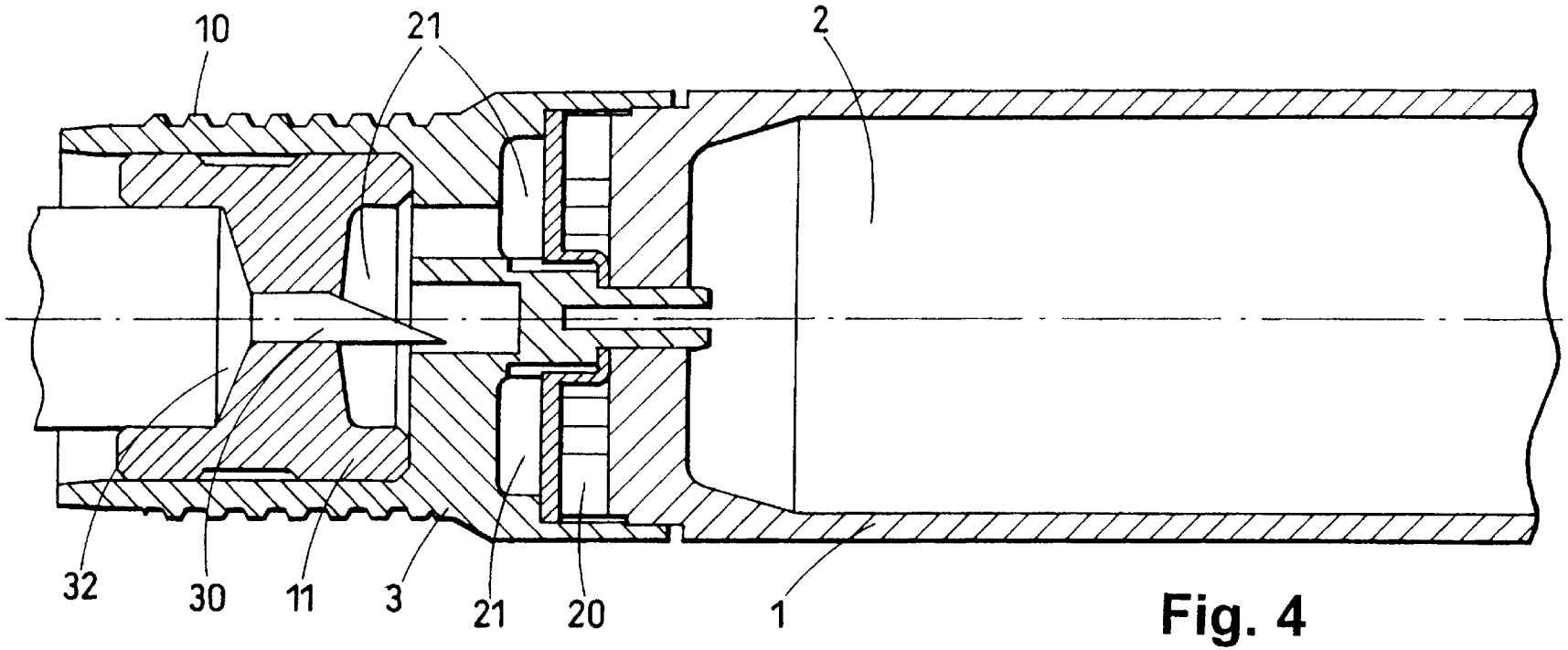
Figure 5:
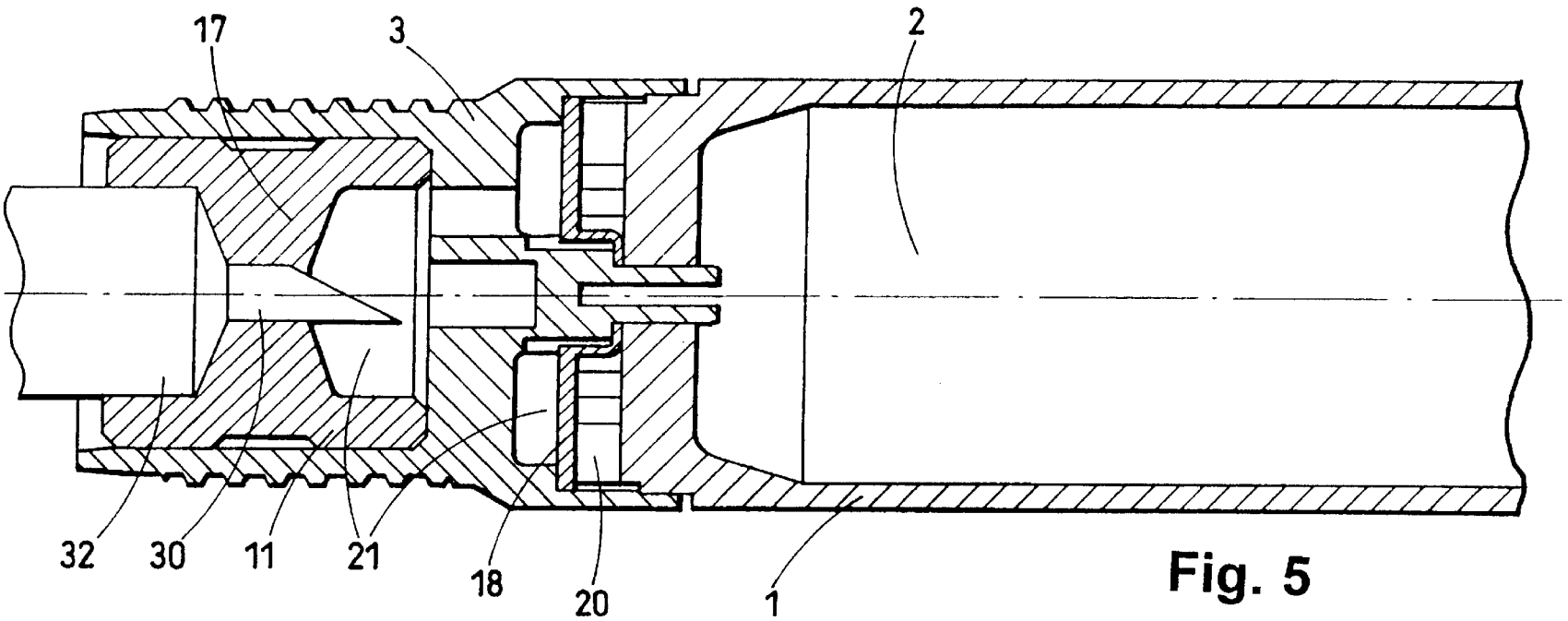

FIG. 2B corresponds to FIG. 2A and shows the valve in an open condition;

FIG. 3 shows the forward end of the cartridge during an initial stage of inserting the cartridge into a writing instrument;

FIG. 4 shows the forward end of the cartridge after installation in the writing instrument is complete; and FIG. 5 shows the forward end of the cartridge during removal from the writing instrument.

The ink cartridge illustrated in the drawing has a cylindrical body consisting of a cartridge case 1 enclosing a large volume ink reservoir chamber 2, and a valve housing member 3. The rear end of the case is shown fitted with a plug 4 which defines an air hole to allow air to enter the case to replace the volume of ink as it is used up. As well known in the art, a grease follower plug 5 is provided in the reservoir to separate the ink from the air, this plug sliding along the interior of the case as it becomes emptied of ink. The case has a flat front end wall 6 with a central hole through which extends an axial spigot 7 integrally moulded with the valve housing member 3. The housing member also includes a rearwardly directed sleeve 9 which extends about the spigot 7 and is securely attached to the forward end of the cartridge case, e.g. by welding, and a forwardly extending tubular part 10 which is externally screw threaded for releasable coupling with a writing instrument. Received in the tubular part is a deformable seal member 11 including a transverse wall 17 which is adapted to be pierced to enable ink to be delivered from the cartridge interior as explained below. The spigot 7 has a cylindrical surface 12 forming a valve seat and separated from the spigot part which extends through the case front wall by a radial shoulder 13. At least one ink feed channel defined by a longitudinal slot or groove 14 extends along the spigot from its rear end and terminates at the valve seat surface. Further longitudinal grooves 15 extend along the valve seat surface at circumferential positions spaced from the groove 14. The grooves 15 are normally isolated from the groove 14 by a valve member having a cylindrical part 16 which extends about the valve seat surface and by contacting the area of this surface between the grooves 14, 15 prevents flow of ink from the groove 14 to the grooves 15. The valve member includes an actuating portion in the form of a diaphragm 18 integrally connected to the forward end of cylindrical part 16, and an inwardly directed annular sealing lip 19 which is held and serves to seal between the shoulder 13 of the spigot 7 and the front wall 6 of the cartridge case. The outer peripheral edge of the diaphragm 18 is supported by an annular shoulder defined within the valve housing member, and it is held in sealing abutment with this shoulder by a series of spline-like projections spaced around the interior of the valve housing. The diaphragm 18 separates an air chamber 20, which is in free communication with ambient atmosphere through an air port (not shown), from an ink transfer chamber 21 which communicates with the ink feed grooves 15. The transfer chamber 21 includes the interior of the tubular part 10 of the valve housing member behind the seal member 11.

The writing instrument with which the ink cartridge is intended to be used includes a socket with an internal screw thread for cooperation with the external screw thread of the tubular part 10, and a piercing element 30 (FIG. 3) axially located within the socket and having an ink duct forming at least an initial part of an ink feed system within the writing instrument for conducting ink to a writing tip, such as a conventional nib.

The ink cartridge is supplied with the reservoir and transfer chambers filled with ink. When the cartridge is inserted in the writing instrument, the sharp end of the piercing element 30 engages and pierces the transverse wall 17 of the seal member 11, as shown in FIG. 3, this piercing being achieved without any significant deformation of the seal member 11 and serving to establish communication between the transfer chamber 21 and the ink feed system of the writing instrument. As the forward end of the cartridge is screwed into the socket of the writing instrument: a shroud 32 (FIG. 4) extending about the piercing element 30 bears against and displaces rearwardly the sealing member 11, thereby reducing the volume of the transfer chamber 21. However, there is no substantial pressurization of the ink in this chamber, the ink displaced by the volume reduction being free to pass into the ink feed system of the writing instrument. This initial displacement of ink ensures the ink feed system is primed and that the writing instrument will immediately commence writing after the cartridge has been correctly inserted.

Continued use of the writing instrument will cause the pressure in the transfer chamber 21 to be reduced as a result of the capillary suction in the ink feed system, so that a pressure differential is created across the actuating diaphragm 18 of the valve member. When the pressure differential reaches a certain level, the diaphragm is caused to bow forwardly sufficiently to lift the cylindrical part 16 off of the valve seat surface 12, as illustrated in FIG. 2B, and thereby establish communication between the ink feed grooves 14, 15 so that ink passes from the reservoir chamber 2 to the transfer chamber 21. It will be understood that the ink feed is controlled with ink being allowed to leave the reservoir chamber 2 only when there is a demand for ink at the writing tip. When the ink in the reservoir has been depleted and the cartridge is to be replaced, releasing the cartridge from the writing instrument causes the seal member 11 to return to its original condition, the volume of the transfer chamber 21 consequently increasing. However, the reduction in pressure caused in the transfer chamber does not result in ink being sucked back through the ink feed system since the pressure reduction is limited by the valve opening and residual ink remaining in the reservoir chamber 2 passing through valve into the transfer chamber 21.

It will be noted that all the component parts of the described cartridge are arranged for axial assembly. The valve member is assembled axially with the valve housing 3 prior to axial assembly of the latter with the cartridge case 1.

Furthermore, the seal member 11 is assembled axially with the valve housing 3 and the end plug 4 is assembled axially with the case. All of these components are suitable for manufacture as plastics mouldings so that production of the cartridge can be achieved economically.

What is claimed is:

1. A cartridge for a marking instrument, comprising a body enclosing a reservoir chamber having an axis, a transfer chamber, a valve device for controlling communication between the reservoir chamber and transfer chamber, the valve device having a valve seat and a valve member including a sealing portion for co-operation with the seat and an actuating portion exposed on one side to the pressure in the transfer chamber and on the other side to ambient atmospheric pressure, the valve seat and valve member being assembled in substantially coaxial alignment with the axis of the reservoir chamber, wherein the valve seat comprises a cylindrical surface, and the valve member includes a cylindrical portion for co-operation with the seat and an actuating diaphragm attached to one end of the cylindrical portion of the valve member.

2. A cartridge according to claim 1, wherein the reservoir chamber is defined within a case, the transfer chamber is defined within a valve housing member coaxially mounted to the forward end of the case, and the valve seat is provided on a part integral with the valve housing member.

3. A cartridge according to claim 2, wherein the valve member includes a sealing lip attached to the other end of the cylindrical part and arranged to seal between the valve seal and the case.

4. A cartridge chamber according to claim 2, wherein the valve seat part extends through a central hole in a forward end wall of the case, and the valve housing member includes a rearwardly directed cylindrical part secured to the forward end of the case.

5. A cartridge chamber according to claim 1, wherein the valve housing member has a rearwardly facing internal annular shoulder against which the outer peripheral edge of the diaphragm is supported.

6. A cartridge according to claim 1, wherein at least one first ink feed channel communicating with the reservoir chamber opens at the valve seat surface, and at least one ink feed groove communicating with the transfer chamber extends along the valve seat surface at a position spaced circumferentially from the at least one ink feed channel.

* * * * *